US008904726B1

(12) United States Patent
Hohmann, Jr.

(10) Patent No.: US 8,904,726 B1
(45) Date of Patent: Dec. 9, 2014

(54) VERTICALLY ADJUSTABLE DISENGAGEMENT PREVENTION VENEER TIE AND ANCHORING SYSTEM UTILIZING THE SAME

(71) Applicant: Mitek Holdings, Inc., Wilmington, DE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 13/930,866

(22) Filed: Jun. 28, 2013

(51) Int. Cl.
*E04B 1/16* (2006.01)
*E04B 1/41* (2006.01)

(52) U.S. Cl.
CPC ..... *E04B 1/4178* (2013.01)
USPC ..... 52/379; 52/513; 52/712; 52/713

(58) Field of Classification Search
USPC ..... 52/410, 508, 378–380, 383, 561–565, 52/698–714, 568, 424–431, 309.1, 364, 52/415, 434
See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest, Jr. |
| 1,170,419 | A | 2/1916 | Coon et al. |
| RE15,979 | E | 1/1925 | Schaefer et al. |
| 1,794,684 | A | 3/1931 | Handel |
| 1,936,223 | A | 11/1933 | Awbrey |
| 2,058,148 | A | 10/1936 | Hard |
| 2,097,821 | A | 11/1937 | Mathers |
| 2,280,647 | A | 4/1942 | Hawes |
| 2,300,181 | A | 10/1942 | Spaight |
| 2,403,566 | A | 7/1946 | Thorp et al. |

(Continued)

FOREIGN PATENT DOCUMENTS

| | | |
|---|---|---|
| CH | 279209 | 3/1952 |
| EP | 0199595 | 3/1995 |

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Brian Glessner
*Assistant Examiner* — Beth Stephan
(74) *Attorney, Agent, or Firm* — Silber & Fridman

(57) ABSTRACT

A high-strength disengagement prevention pintle veneer tie and anchoring system employing the same is disclosed. The high-strength veneer tie utilizes modified compressed wire formatives formed from a wire formative construct that is cold-worked, with the resultant body having substantially semicircular edges and flat surfaces therebetween. The edges are aligned to receive compressive forces transmitted from the outer wythe. The veneer tie hereof, when part of the anchoring system, interengages with wall anchor and is dimensioned to preclude veneer tie movement and pullout through the use of the U-shaped securement portions. The veneer tie is installed within the wall anchor through a swinging motion, in either an over and through or under and through the anchor installation, fully securing the veneer tie within the anchor and providing flexibility during installation.

18 Claims, 8 Drawing Sheets

(56) References Cited

U.S. PATENT DOCUMENTS

| | | | |
|---|---|---|---|
| 2,413,772 | A | 1/1947 | Morehouse |
| 2,605,867 | A | 8/1952 | Goodwin |
| 2,780,936 | A | 2/1957 | Hillberg |
| 2,898,758 | A | 8/1959 | Henrickson |
| 2,929,238 | A | 3/1960 | Kaye |
| 2,966,705 | A | 1/1961 | Massey |
| 2,999,571 | A | 9/1961 | Huber |
| 3,030,670 | A | 4/1962 | Bigelow |
| 3,183,628 | A | 5/1965 | Smith |
| 3,254,736 | A | 6/1966 | Gass |
| 3,277,626 | A | 10/1966 | Brynjolfsson et al. |
| 3,309,828 | A | 3/1967 | Tribble |
| 3,341,998 | A | 9/1967 | Lucas |
| 3,377,764 | A | 4/1968 | Storch |
| 3,478,480 | A | 11/1969 | Swenson |
| 3,563,131 | A | 2/1971 | Ridley, Sr. |
| 3,568,389 | A | 3/1971 | Gulow |
| 3,640,043 | A | 2/1972 | Querfeld et al. |
| 3,964,226 | A | 6/1976 | Hala et al. |
| 3,964,227 | A | 6/1976 | Hala |
| 4,021,990 | A | 5/1977 | Schwalberg |
| 4,227,359 | A | 10/1980 | Schlenker |
| 4,238,987 | A | 12/1980 | Siebrecht-Reuter |
| 4,305,239 | A | 12/1981 | Geraghty |
| 4,373,314 | A | 2/1983 | Allan |
| 4,382,416 | A | 5/1983 | Kellogg-Smith |
| 4,424,745 | A | 1/1984 | Magorian et al. |
| 4,438,611 | A | 3/1984 | Bryant |
| 4,473,984 | A | 10/1984 | Lopez |
| 4,482,368 | A | 11/1984 | Roberts |
| 4,571,909 | A | 2/1986 | Berghuis et al. |
| 4,596,102 | A | 6/1986 | Catani et al. |
| 4,598,518 | A | 7/1986 | Hohmann |
| 4,606,163 | A | 8/1986 | Catani |
| 4,622,796 | A | 11/1986 | Aziz et al. |
| 4,628,657 | A | 12/1986 | Ermer et al. |
| 4,636,125 | A | 1/1987 | Burgard |
| 4,640,848 | A | 2/1987 | Cerdan-Diaz et al. |
| 4,660,342 | A | 4/1987 | Salisbury |
| 4,703,604 | A | 11/1987 | Muller |
| 4,708,551 | A | 11/1987 | Richter et al. |
| 4,738,070 | A | 4/1988 | Abbott et al. |
| 4,764,069 | A | 8/1988 | Reinwall et al. |
| 4,819,401 | A | 4/1989 | Whitney, Jr. |
| 4,827,684 | A | 5/1989 | Allan |
| 4,843,776 | A | 7/1989 | Guignard |
| 4,852,320 | A | 8/1989 | Ballantyne |
| 4,869,038 | A | 9/1989 | Catani |
| 4,869,043 | A | 9/1989 | Hatzinikolas et al. |
| 4,875,319 | A | 10/1989 | Hohmann |
| 4,911,949 | A | 3/1990 | Iwase et al. |
| 4,922,680 | A | 5/1990 | Kramer et al. |
| 4,946,632 | A | 8/1990 | Pollina |
| 4,955,172 | A | 9/1990 | Pierson |
| 5,063,722 | A | 11/1991 | Hohmann |
| 5,099,628 | A | 3/1992 | Noland et al. |
| 5,207,043 | A | 5/1993 | McGee et al. |
| 5,307,602 | A | 5/1994 | Lebraut |
| 5,392,581 | A | 2/1995 | Hatzinikolas et al. |
| 5,408,798 | A | 4/1995 | Hohmann |
| 5,440,854 | A | 8/1995 | Hohmann |
| 5,454,200 | A | 10/1995 | Hohmann |
| 5,456,052 | A | 10/1995 | Anderson et al. |
| 5,490,366 | A | 2/1996 | Burns et al. |
| 5,598,673 | A | 2/1997 | Atkins |
| 5,634,310 | A | 6/1997 | Hohmann |
| 5,669,592 | A | 9/1997 | Kearful |
| 5,671,578 | A | 9/1997 | Hohmann |
| 5,673,527 | A | 10/1997 | Coston et al. |
| 5,755,070 | A | 5/1998 | Hohmann |
| 5,816,008 | A | 10/1998 | Hohmann |
| 5,819,486 | A | 10/1998 | Goodings |
| 5,845,455 | A | 12/1998 | Johnson, III |
| 6,000,178 | A | 12/1999 | Goodings |
| 6,125,608 | A | 10/2000 | Charlson |
| 6,209,281 | B1 | 4/2001 | Rice |
| 6,279,283 | B1 | 8/2001 | Hohmann et al. |
| 6,284,311 | B1 | 9/2001 | Gregorovich et al. |
| 6,332,300 | B1 | 12/2001 | Wakai |
| 6,351,922 | B1 | 3/2002 | Burns et al. |
| 6,367,219 | B1 | 4/2002 | Quinlan |
| 6,612,343 | B2 | 9/2003 | Camberlin et al. |
| 6,627,128 | B1 | 9/2003 | Boyer |
| 6,668,505 | B1 | 12/2003 | Hohmann et al. |
| 6,686,301 | B2 | 2/2004 | Li et al. |
| 6,735,915 | B1 | 5/2004 | Johnson, III |
| 6,739,105 | B2 | 5/2004 | Fleming |
| 6,789,365 | B1 | 9/2004 | Hohmann et al. |
| 6,817,147 | B1 | 11/2004 | MacDonald |
| 6,827,969 | B1 | 12/2004 | Skoog et al. |
| 6,837,013 | B2 | 1/2005 | Foderberg et al. |
| 6,851,239 | B1 | 2/2005 | Hohmann et al. |
| 6,925,768 | B2 | 8/2005 | Hohmann et al. |
| 6,941,717 | B2 | 9/2005 | Hohmann et al. |
| 6,968,659 | B2 | 11/2005 | Boyer |
| 7,007,433 | B2 | 3/2006 | Boyer |
| 7,017,318 | B1 | 3/2006 | Hohmann et al. |
| 7,043,884 | B2 | 5/2006 | Moreno |
| 7,059,577 | B1 | 6/2006 | Burgett |
| D527,834 | S | 9/2006 | Thimons et al. |
| 7,147,419 | B2 | 12/2006 | Balbo Di Vinadio |
| 7,152,382 | B2 | 12/2006 | Johnson, III |
| 7,171,788 | B2 | 2/2007 | Bronner |
| 7,178,299 | B2 | 2/2007 | Hyde et al. |
| D538,948 | S | 3/2007 | Thimons et al. |
| 7,225,590 | B1 | 6/2007 | diGirolamo et al. |
| 7,325,366 | B1 | 2/2008 | Hohmann, Jr. et al. |
| 7,334,374 | B2 | 2/2008 | Schmid |
| 7,374,825 | B2 | 5/2008 | Hazel et al. |
| 7,415,803 | B2 | 8/2008 | Bronner |
| 7,469,511 | B2 | 12/2008 | Wobber |
| 7,481,032 | B2 | 1/2009 | Tarr |
| 7,552,566 | B2 | 6/2009 | Hyde et al. |
| 7,562,506 | B2 | 7/2009 | Hohmann, Jr. |
| 7,587,874 | B2 | 9/2009 | Hohmann, Jr. |
| 7,735,292 | B2 | 6/2010 | Massie |
| 7,748,181 | B1 | 7/2010 | Guinn |
| 7,788,869 | B2 | 9/2010 | Voegele, Jr. |
| D626,817 | S | 11/2010 | Donowho et al. |
| 7,845,137 | B2 | 12/2010 | Hohmann, Jr. |
| 8,037,653 | B2 | 10/2011 | Hohmann, Jr. |
| 8,051,619 | B2 | 11/2011 | Hohmann, Jr. |
| 8,096,090 | B1 | 1/2012 | Hohmann, Jr. et al. |
| 8,109,706 | B2 | 2/2012 | Richards |
| 8,122,663 | B1 | 2/2012 | Hohmann, Jr. et al. |
| 8,201,374 | B2 | 6/2012 | Hohmann, Jr. |
| 8,209,934 | B2 | 7/2012 | Pettingale |
| 8,215,083 | B2 | 7/2012 | Toas et al. |
| 8,291,672 | B2 | 10/2012 | Hohmann, Jr. et al. |
| 8,347,581 | B2 | 1/2013 | Doerr et al. |
| 8,375,667 | B2 | 2/2013 | Hohmann, Jr. |
| 8,418,422 | B2 | 4/2013 | Johnson, III |
| 8,511,041 | B2 | 8/2013 | Fransen |
| 8,516,763 | B2 | 8/2013 | Hohmann, Jr. |
| 8,516,768 | B2 | 8/2013 | Johnson, III |
| 8,544,228 | B2 | 10/2013 | Bronner |
| 8,555,587 | B2 | 10/2013 | Hohmann, Jr. |
| 8,555,596 | B2 | 10/2013 | Hohmann, Jr. |
| 8,596,010 | B2 | 12/2013 | Hohmann, Jr. |
| 8,613,175 | B2 | 12/2013 | Hohmann, Jr. |
| 8,667,757 | B1 | 3/2014 | Hohmann, Jr. |
| 2001/0054270 | A1 | 12/2001 | Rice |
| 2002/0100239 | A1 | 8/2002 | Lopez |
| 2003/0121226 | A1 | 7/2003 | Bolduc |
| 2003/0217521 | A1 | 11/2003 | Richardson et al. |
| 2004/0083667 | A1 | 5/2004 | Johnson, III |
| 2004/0216408 | A1 | 11/2004 | Hohmann, Jr. |
| 2004/0216413 | A1 | 11/2004 | Hohmann et al. |
| 2004/0216416 | A1 | 11/2004 | Hohmann et al. |
| 2004/0231270 | A1 | 11/2004 | Collins et al. |
| 2005/0279043 | A1 | 12/2005 | Bronner |
| 2006/0005490 | A1 | 1/2006 | Hohmann, Jr. |
| 2006/0198717 | A1 | 9/2006 | Fuest |
| 2006/0242921 | A1 | 11/2006 | Massie |

(56) References Cited

U.S. PATENT DOCUMENTS

| | | | | |
|---|---|---|---|---|
| 2006/0251916 | A1 | 11/2006 | Arikawa et al. | |
| 2008/0092472 | A1 | 4/2008 | Doerr et al. | |
| 2008/0141605 | A1 | 6/2008 | Hohmann | |
| 2008/0222992 | A1 | 9/2008 | Hikai et al. | |
| 2009/0133351 | A1 | 5/2009 | Wobber | |
| 2009/0133357 | A1 | 5/2009 | Richards | |
| 2010/0037552 | A1 | 2/2010 | Bronner | |
| 2010/0071307 | A1 | 3/2010 | Hohmann, Jr. | |
| 2010/0101175 | A1 | 4/2010 | Hohmann | |
| 2010/0192495 | A1 | 8/2010 | Huff et al. | |
| 2010/0257803 | A1 | 10/2010 | Hohmann, Jr. | |
| 2011/0023748 | A1 | 2/2011 | Wagh et al. | |
| 2011/0041442 | A1 | 2/2011 | Bui | |
| 2011/0047919 | A1 | 3/2011 | Hohmann, Jr. | |
| 2011/0061333 | A1 | 3/2011 | Bronner | |
| 2011/0083389 | A1 | 4/2011 | Bui | |
| 2011/0146195 | A1 | 6/2011 | Hohmann, Jr. | |
| 2011/0173902 | A1 | 7/2011 | Hohmann et al. | |
| 2011/0277397 | A1 | 11/2011 | Hohmann, Jr. | |
| 2012/0186183 | A1 * | 7/2012 | Johnson, III | 52/565 |
| 2012/0285111 | A1 | 11/2012 | Johnson, III | |
| 2012/0304576 | A1 | 12/2012 | Hohmann, Jr. | |
| 2012/0308330 | A1 | 12/2012 | Hohmann, Jr. | |
| 2013/0008121 | A1 | 1/2013 | Dalen | |
| 2013/0074435 | A1 | 3/2013 | Hohmann, Jr. | |
| 2013/0074442 | A1 | 3/2013 | Hohmann, Jr. | |
| 2013/0232893 | A1 | 9/2013 | Hohmann, Jr. | |
| 2013/0232909 | A1 | 9/2013 | Curtis et al. | |
| 2013/0247482 | A1 | 9/2013 | Hohmann, Jr. | |
| 2013/0247483 | A1 | 9/2013 | Hohmann, Jr. | |
| 2013/0247484 | A1 | 9/2013 | Hohmann, Jr. | |
| 2013/0247498 | A1 | 9/2013 | Hohmann, Jr. | |
| 2013/0340378 | A1 | 12/2013 | Hohmann, Jr. | |
| 2014/0000211 | A1 | 1/2014 | Hohmann, Jr. | |

FOREIGN PATENT DOCUMENTS

| | | | |
|---|---|---|---|
| GB | 1575501 | | 9/1980 |
| GB | 2069024 | A | 8/1981 |
| GB | 2246149 | A | 1/1992 |
| GB | 2265164 | A | 9/1993 |
| GB | 2459936 | B | 3/2013 |

OTHER PUBLICATIONS

Building Envelope Requirements, 780 CMR sec. 1304.0 et seq. of Chapter 13, Jan. 1, 2001, 19 pages, Boston, Massachusetts, United States.

Building Code Requirements for Masonry Structures, TMS 402-11/ACI 530-11/ASCE 5-11, Chapter 6, 12 pages.

Hohmann & Barnard, Inc.; Product Catalog, 2013, 52 pages, Hauppauge, New York, United States.

ASTM Standard A-951, Standard Specification for Steel Wire for Masonry Joint Reinforcement, Table 1, 6 pages.

ASTM Standard Specification A951/A951M-11, Table 1, Standard Specification for Steel Wire for Masonry Joint Reinforcement, Nov. 14, 2011, 6 pages, West Conshohocken, Pennsylvania, United States.

Hohmann & Barnard, Product Catalog, 44 pgs (2003).

Hohmann & Barnard, Inc.; Product Catalog, 2009, 52 pages, Hauppauge, New York, United States.

Kossecka, PH.D, et al., Effect of Insulation and Mass Distribution in Exterior Walls on Dynamic Thermal Performance of Whole Buildings, Thermal Envelopes VII/Building Systems—Principles p. 721-731, 1998, 11 pages.

* cited by examiner

VERTICALLY ADJUSTABLE DISENGAGEMENT PREVENTION VENEER TIE AND ANCHORING SYSTEM UTILIZING THE SAME

BACKGROUND OF THE INVENTION

1. Field of the Invention

This invention relates to an improved anchoring arrangement for use in conjunction with cavity walls having an inner wythe and an outer wythe. More particularly, the invention relates to construction accessory devices, namely, veneer ties with modified pullout resistant ribbon compressed pintles. The veneer ties are for emplacement in the outer wythe and are further accommodated by receptors in the cavity, which receptors extend from the inner wythe to encapture the specially configured pintles hereof. The invention is applicable to structures having an outer wythe of brick or stone facing in combination with an inner wythe of either masonry block or dry wall construction.

2. Description of the Prior Art

In the past, investigations relating to the effects of various forces, particularly lateral forces, upon brick veneer masonry construction demonstrated the advantages of having high-strength wire anchoring components embedded in the bed joints of anchored veneer walls, such as facing brick or stone veneer. Anchors and ties are generally placed in one of the following five categories: corrugated; sheet metal; wire; two-piece adjustable; or joint reinforcing. The present invention has a focus on wire formatives and in particular, high-strength pintle ties.

Prior tests have shown that failure of anchoring systems frequently occurs at the juncture between the pintle of the veneer tie and the receptor portion of the wall anchor. This invention addresses the need for a high-strength pintle suitable for use with both masonry block and dry wall construction that provides a strong pintle-to-receptor connection and further provides high strength pullout resistance, through a novel U-shaped securement, combined with ease of installation within the wall anchor.

Early in the development of high-strength anchoring systems an important prior patent, namely U.S. Pat. No. 4,875,319 ('319), to Ronald P. Hohmann in which a molded plastic clip is described, tied together a reinforcing wire and a veneer tie. The assignee of '319, Hohmann & Barnard, Inc., now a MiTek-Berkshire Hathaway company, successfully commercialized the device under the SeismiClip trademark. For many years, the white plastic clip tying together the veneer anchor and the reinforcement wire in the outer wythe has been a familiar item in commercial seismic-zone buildings.

Additionally, the high-strength pintle hereof has been combined with the swaged leg as shown in the inventor's patent, U.S. Pat. No. 7,325,366. The combination item reduces the number of "bits and pieces" brought to the job site and simplifies installation.

The high-strength pintle is specially configured to prevent veneer tie pullout. The configured pintle restricts movement in all directions, ensuring a high-strength connection and transfer of forces between the veneer and the backup wall. The high-strength pintle is compressively reduced in height by the cold-working thereof to increase the veneer tie strength. Because the wire formative hereof employs extra strong material and benefits from the cold-working of the metal alloys, the anchoring system meets the unusual requirements demanded in current building structures. Reinforcement wires are included to form seismic constructs.

There have been significant shifts in public sector building specifications which have resulted in architects and architectural engineers requiring larger and larger cavities in the exterior cavity walls of public buildings. These requirements are imposed without corresponding decreases in wind shear and seismic resistance levels or increases in mortar bed joint height. Thus, the wall anchors needed are restricted to occupying the same ⅜-inch bed joint height in the inner and outer wythes. Thus, the veneer facing material is tied down over a span of two or more times that which had previously been experienced. Exemplary of the public sector building specification is that of the *Energy Code Requirement*, Boston, Mass. (See Chapter 13 of 780 *CMR, Seventh Edition*). This Code sets forth insulation R-values well in excess of prior editions and evokes an engineering response opting for thicker insulation and correspondingly larger cavities.

Besides earthquake protection requiring high-strength anchoring systems, the failure of several high-rise buildings to withstand wind and other lateral forces has resulted in the promulgation of more stringent Uniform Building Code provisions. This high-strength pullout resistant pintle is a partial response thereto. The inventor's related anchoring system products have become widely accepted in the industry.

The following patents are believed to be relevant and are disclosed as being known to the inventor hereof:

| U.S. Pat. No. | Inventor | Issue Date |
|---|---|---|
| 3,377,764 | Storch | Apr. 16, 1968 |
| 4,869,038 | Catani | Sep. 26, 1989 |
| 5,454,200 | Hohmann | Oct. 3, 1995 |
| 5,490,366 | Burns, et al. | Feb. 13, 1996 |
| 6,668,505 | Hohmann et al. | Dec. 30, 2003 |
| 6,789,365 | Hohmann et al. | Sep. 14, 2004 |
| 6,851,239 | Hohmann et al. | Feb. 8, 2005 |
| 7,017,318 | Hohmann et al. | Mar. 28, 2006 |
| 7,325,366 | Hohmann et al. | Feb. 5, 2008 |

It is noted that these devices are generally descriptive of wire-to-wire anchors and wall ties and have various cooperative functional relationships with straight wire runs embedded in the interior and/or exterior wythe.

U.S. Pat. No. 3,377,764—B. Storch—Issued Apr. 16, 1968

Discloses a bent wire, tie-type anchor for embedment in a facing exterior wythe engaging with a loop attached to a straight wire run in a backup interior wythe.

U.S. Pat. No. 4,869,038—M. J. Catani—Issued Sep. 26, 1989

Discloses a veneer wall anchor system having in the interior wythe a truss-type anchor with horizontal sheetmetal extensions. The extensions are interlocked with bent wire pintle-type wall ties that are embedded within the exterior wythe.

U.S. Pat. No. 5,454,200—R. Hohmann—Issued Oct. 3, 1995

Discloses a facing anchor with straight wire run and mounted along the exterior wythe to receive the open end of wire wall tie with each leg thereof being placed adjacent one side of reinforcement wire. As the eye wires hereof have scaled eyelets or loops and the open ends of the wall ties are sealed in the joints of the exterior wythes, a positive interengagement results.

U.S. Pat. No. 5,490,366—Burns et al.—Issued Feb. 13, 1996

Discloses an adjustable anchor and tying device. The Burns device describes an anchoring and vertically adjustable double-end hook tie for securing spaced wythes to a structural wall.

U.S. Pat. No. 6,668,505—Hohmann et al.—Issued Dec. 30, 2003

Discloses high-span and high-strength anchors and reinforcement devices for cavity walls combined with interlocking veneer ties which utilize reinforcing wire and wire formatives to form facing anchors, truss or ladder reinforcements, and wall anchors providing wire-to-wire connections therebetween.

U.S. Pat. No. 6,789,365—R. Hohmann et al.—Issued Sep. 14, 2004

Discloses side-welded anchor and reinforcement devices for a cavity wall. The devices are combined with interlocking veneer anchors, and with reinforcements to form unique anchoring systems. The components of each system are structured from reinforcing wire and wire formatives.

U.S. Pat. No. 6,851,239—Hohmann et al.—Issued Feb. 8, 2005

Discloses a high-span anchoring system for a cavity wall which incorporates a wall reinforcement combined with a wall tie, together serving as a wall construct having a larger-than-normal cavity. Further the various embodiments combine wire formatives which are compressively reduced in height by the cold-working thereof. Among the embodiments is a veneer anchoring system with a low-profile wall tie for use in a heavily insulated wall.

U.S. Pat. No. 7,017,318—Hohmann et al.—Issued Mar. 28, 2006

Discloses an anchoring system with low-profile wall ties in which insertion portions of the wall anchor and the veneer anchor are compressively reduced in height.

U.S. Pat. No. 7,325,366—Hohmann, Jr. et al.—Issued Feb. 5, 2008

Discloses snap-in veneer ties for a seismic construction system in cooperation with low-profile, high-span wall anchors.

None of the above anchors or anchoring systems provide a U-shaped reversible disengagement prevention veneer tie having a high-strength pintle veneer tie for fulfilling the need for enhanced compressive and tensile properties and ease and flexibility of installation. This invention relates to an improved anchoring arrangement for use in conjunction with cavity walls having an inner wythe and an outer wythe and meets the heretofore unmet need described above.

SUMMARY

In general terms, the invention disclosed hereby is a high-strength reversible disengagement resistant veneer tie and an anchoring system utilizing the same for cavity walls. The system includes a wire-formative veneer tie for emplacement in the outer wythe and interconnection with the wall anchor. The high-strength construction system hereof is applicable to construction of a wall having an inner wythe, which can either be of dry wall construction or masonry block, and a masonry outer wythe, as well as to insulated and non-insulated structures. The wythes are in a spaced apart relationship and form a cavity therebetween. In the disclosed system, a unique combination of a wall anchor (attachable to either ladder- or truss-type reinforcement for masonry inner wythes or to metal studs of a dry wall construct), a wire veneer tie, and, optionally, a continuous wire reinforcement is provided. The invention contemplates that the veneer ties are wire formatives with an interconnecting portion comprised of high-strength ribbon pintles with U-shaped securement portions for swing installation, in either an over and through or under and through wall anchor interconnection. The nature of the installation provides on-site flexibility to the mason to ensure proper location of the veneer tie within the bed joint of the outer wythe. The interconnecting portion surrounds the anchor to restrict movement in all directions while allowing limited vertical alignment capability. The interconnecting portion of the wire formative veneer ties is compressively reduced in height by the cold-working thereof to increase the veneer tie strength.

In the first embodiment of this invention, the veneer tie is constructed from a wire formative and has configured ribbon pintles that provide a high strength connection, restricting vertical, lateral and horizontal movement and pullout when interconnected with a wall anchor and embedded in the bed joint of the outer wythe. The veneer tie is engaged with a wall anchor that is interconnected with a ladder- or truss-type reinforcement. The anchor is configured with either a single bar or an eyelet as an extension of or extending from the receptor portions into the cavity between the wythes. The veneer tie is positioned so that the insertion end thereof is embedded in the bed joint of the outer wythe. The construction of the veneer tie results in an orientation upon emplacement so that the widest part of the elbow portions are subjected to compressive and tensile forces. In this embodiment the insertion end of the veneer tie is positioned on the outer wythe and optionally, a continuous reinforcement wire can be snapped into a variation of the veneer tie and secured to the outer wythe.

The second embodiment further includes a dry wall construct inner wythe. Here, the dry-wall anchor is a metal stamping and is attached by sheetmetal screws to the metal vertical channel members of the wall. Each dry-wall anchor accommodates in a horizontally extending portion, the interconnecting portion of the wire formative veneer tie. The U-shaped securement portion of the interconnecting portion prevents veneer tie pullout, while the elbow, cavity and insertion portion provides for ease of installation through a swinging motion. In this embodiment, the insertion end of the veneer tie is positioned on the outer wythe and optionally, a continuous reinforcement wire can be snapped into a variation of the veneer tie and secured to the outer wythe.

It is an object of the present invention to provide in an anchoring system having an outer wythe and an inner wythe, a high-strength veneer tie that interengages a wall anchor which system further includes a specially-configured veneer tie with disengagement prevention ribbon pintles.

It is another object of the present invention to provide labor-saving devices to simplify seismic and nonseismic high-strength installations of brick and stone veneer and the securement thereof to an inner wythe.

It is yet another object of the present invention to provide a cold worked wire formative veneer tie that is characterized by high resistance to compressive and tensile forces.

It is a further object of the present invention to provide an anchoring system for cavity walls comprising a limited number of component parts that are economical of manufacture, resulting in a relatively low unit cost.

It is yet another object of the present invention to provide an anchoring system which restricts lateral, vertical and horizontal movements of the facing wythe with respect to the inner wythe, but remains adjustable vertically.

It is a feature of the present invention that the veneer tie, after being inserted into the receptors therefor, interconnecting portion is oriented so that the widest portion thereof is subjected to compressive to tensile forces.

It is another feature of the present invention that the veneer ties are utilizable with either a masonry block having aligned or unaligned bed joints or for a dry wall construct that secures to a metal stud.

It is yet another feature of the present invention that the specially-configured veneer tie is reversible allowing for installation in either an over and through or under and through engagement accommodating variations in location of the outer wythe bed joints.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

Figure 1:
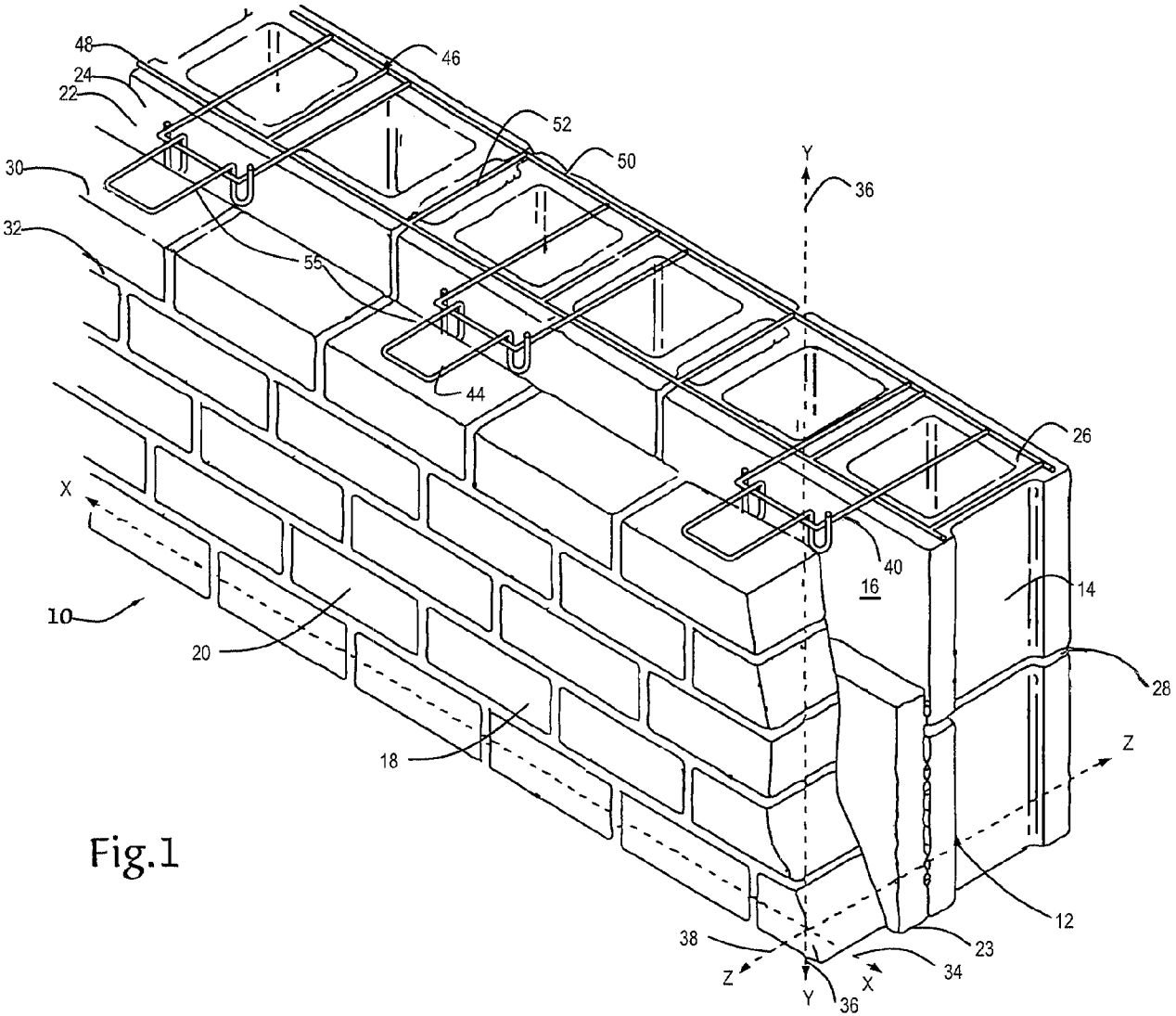
FIG. 1 is a perspective view of an anchoring system having a veneer tie with high-strength disengagement resistant ribbon pintles of this invention and a ladder reinforcement wall anchor and shows a wall with an inner wythe of masonry block and an outer wythe of brick veneer.

In the embodiments described herein the interconnecting portion of the veneer ties is cold-worked or otherwise partially flattened and specially configured, resulting in greater tensile and compressive strength and thereby becoming better suited to cavity walls wherein high wind loads or seismic forces are experienced. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween. The deformed body has substantially the same cross-sectional area as the original wire. Here, the circular cross-section of a wire provides greater flexural strength than a sheetmetal counterpart.

Before proceeding to the detailed description, the following definitions are provided. For purposes of defining the invention at hand, a ribbon pintle is a wire formative that has been compressed by cold working so that the resultant body is substantially semicircular at the edges and has flat surfaces therebetween. In use, the rounded edges are aligned so as to receive compressive forces transmitted from the veneer or outer wythe, which forces are generally normal to the facial plane thereof. In the discussion that follows, the width of the ribbon pintle is also referred to as the major axis and the thickness is referred to as the minor axis.

As the compressive forces are exerted on the ribbon edges, the ribbon pintles withstand forces greater than uncompressed pintles formed from the same gage wire. Data reflecting the enhancement represented by the cold-worked ribbon pintles is included hereinbelow.

The description which follows is of two embodiments of anchoring systems utilizing the high-strength pintle veneer tie devices of this invention, which devices are suitable for non-seismic and seismic cavity wall applications. Although each high-strength veneer tie is adaptable to varied inner wythe structures, the embodiments here apply to cavity walls with masonry block inner wythes, and to a cavity wall with a dry wall (sheetrock) inner wythe. For the masonry structures, mortar bed joint thickness is at least twice the thickness of the embedded anchor.

In accordance, with the *Building Code Requirements for Masonry Structures, ACI* 530-11/*ASCE* 5-11/*TMS* 402-11, *Chapter* 6, each wythe of the cavity wall structure is designed to resist individually the effects of the loads imposed thereupon. Further, the veneer (outer wythe) is designed and detailed to accommodate differential movement and to distribute all external applied loads through the veneer to the inner wythe utilizing masonry anchors and ties.

Referring now to FIGS. 1 through 7 and 11, the first embodiment of the anchoring system hereof including a high-strength reversible disengagement prevention wire formative veneer tie of this invention is shown and is referred to generally by the number 10. In this embodiment, a wall structure 12 is shown having a backup wall or inner wythe 14 of masonry blocks 16 and a veneer facing or outer wythe 18 of facing brick or stone 20. Between the backup wall 14 and the facing wall 18, a cavity 22 is formed, which cavity 22 extends outwardly from the surface 24 of the backup wall 14. Optionally, the cavity is filled with insulation 23.

In this embodiment, successive mortar-filled bed joints 26 and 28 are formed between courses of blocks 16 and the joints are substantially planar and horizontally disposed. Also, successive mortar-filled bed joints 30 and 32 are formed between courses of facing brick 20 and the joints are substantially planar and horizontally disposed. For each structure, the bed joints 26, 28, 30 and 32 are specified as to the height or thickness of the mortar layer and such thickness specification is rigorously adhered to so as to provide the uniformity inherent in quality construction.

For purposes of discussion, the exterior surface 24 of the backup wall 14 contains a horizontal line or x-axis 34 and an intersecting vertical line or y-axis 36. A horizontal line or z-axis 38, normal to the xy-plane, also passes through the coordinate origin formed by the intersecting x- and y-axes. In the discussion which follows, it will be seen that the various anchor structures are constructed to restrict movement interfacially—wythe vs. wythe—along the z-axis 38 and, in this embodiment, along the y- and x-axes 36, 34. The device 10 includes a wall anchor 40 constructed for embedment in bed joint 30, which, in turn, includes a free end 42 with a receptor portion 54 extending into cavity 22. Further, the device 10 includes a wire formative veneer tie or anchor 44 for embedment in bed joint 30.

Figure 2:
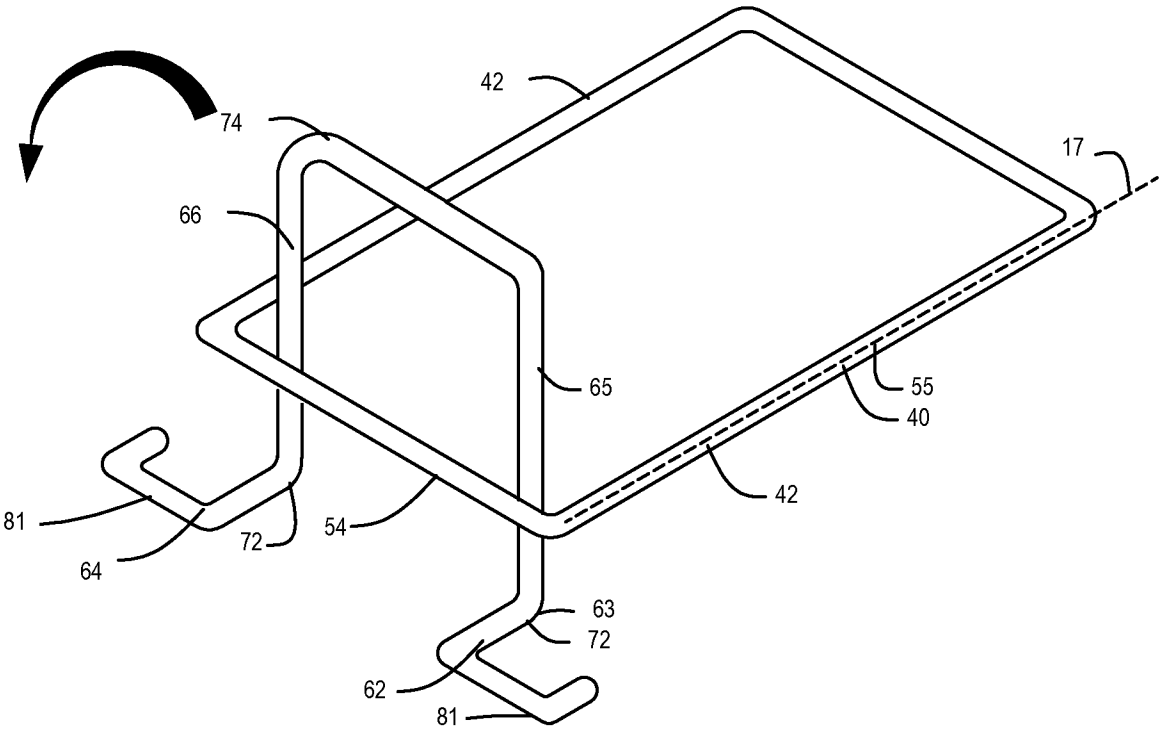
FIG. 2 is a perspective view of the veneer tie and anchor of FIG. 1 showing details of the installation of the veneer tie in an over and through manner within a ladder reinforcement anchoring system.
Figure 3:
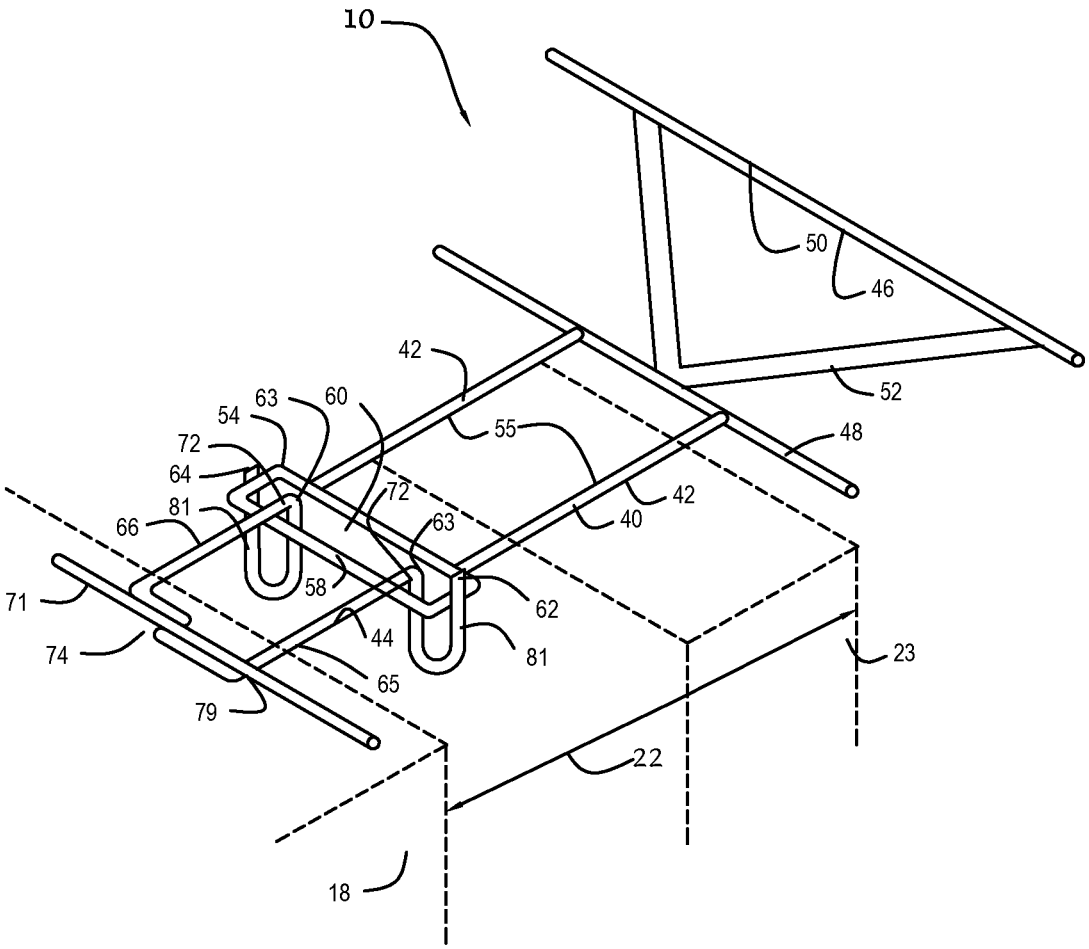
FIG. 3 is a perspective view of an anchoring system similar to FIG. 1 having a veneer tie with high-strength disengagement resistant ribbon pintles of this invention and a truss reinforcement with the wall anchor butt welded thereto, the veneer tie is swaged for interconnection with a reinforcement wire.

The wall anchor 40 is shown in FIG. 1 as being emplaced on a course of blocks 16 in preparation for embedment in the mortar of bed joint 26. In the best mode of practicing this embodiment, a ladder-type wall reinforcement 46 is constructed of a wire formative with two parallel continuous straight wire members 48 and 50 spaced so as, upon installation, to each be centered along the outer walls of the masonry blocks 16. Intermediate wire bodies or cross rods 52 are interposed therebetween and connect wire members 48 and 50 forming ladder-like portions of the reinforcement structure 46. In FIGS. 2 and 3, the cross rods 52 serve as the legs 55 of the anchor 40. Alternatively, the cross rods are formed in a truss shaped manner as shown in FIG. 3, with the legs 55 affixed through butt welding or other similar manner to the wire member 48.

At intervals along the wall reinforcement 46, spaced pairs of legs 55 are attached thereto at wire member 48. Alternatively, the legs 55 are connected with a rear leg and the rear leg is, in turn, attached to the wall reinforcement 46 (not shown). The free end 42 is affixed to the receptor portion 54 which extends into cavity 22 to the veneer tie 44 for interconnection with the interconnecting portion 72. As will become clear by the description which follows, the spacing between the receptor portions 54 is constructed to limit the x-axis 34 movement of the construct. The receptor portion 54, as shown in FIGS. 1 and 2, constitutes a single bar or, as shown in FIG. 3 constitutes a single eyelet 58 formed contiguously therewith and disposed substantially horizontal in the cavity 22. The eyelet 58 is preferably welded closed and has a substantially elongated opening or eye 60.

Figure 10:
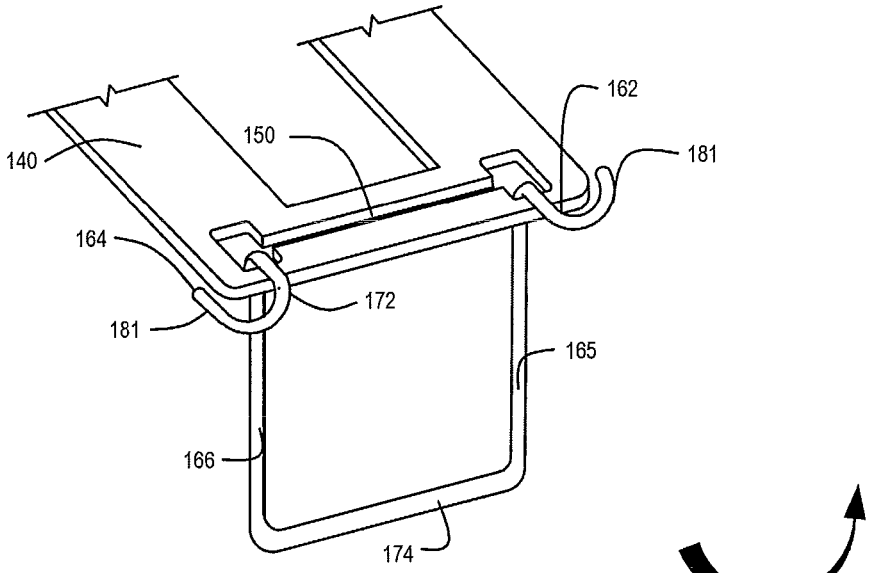
FIG. 10 is a perspective view of the veneer tie and anchor of FIG. 8 showing details of the under and through manner of installation of the veneer tie within the wall anchor; and, FIG. 11 is a cross-sectional view of cold-worked wire used in the formation of the partially compressively reduced pintles hereof and showing resultant aspects of continued compression.

Upon installation, the eye or aperture 60 of eyelet is constructed to be within a substantially horizontal plane normal to exterior surface 24. The aperture 60 is dimensioned to accept the interconnecting portion 72 of the veneer tie 44 therethrough and interconnect with the securement portion 81 to restrict movement of the interconnecting portion 72 beyond the eyelet 58 and control vertical movement of the veneer tie 44. The eyelet 58 and aperture 60 are constructed to accept the swinging insertion of the veneer tie 44, as shown in FIGS. 2 and 10, in either a downwards swinging motion or an upwards swinging motion. This relationship minimizes the movement of the construct while allowing for installation ease and alignment with the bed joints 30, 32. For positive engagement, the aperture 60 of eyelet 58 is sealed, through welding or similar method, forming a closed loop.

The veneer tie 44 is more fully shown in FIGS. 4 through 7. The veneer tie 44, when viewed from a top or bottom elevation, is a modified U-shaped design and is dimensioned to be accommodated by the eyelet 58 previously described. The tie 44 is a metal alloy wire formative constructed from mill galvanized, hot-dip galvanized, stainless steel, bright basic steel, or other similar high-strength material and has an insertion portion 74 for disposition in the bed joint 30 of the outer wythe 18.

Two cavity portions 65, 66 are contiguous with the insertion portion 74 and the interconnecting portion 72. The interconnecting portion 72 includes a first ribbon pintle 62 and a second ribbon pintle 64. Each ribbon pintle 62, 64 includes an elbow portion 63 for interconnection with the receptor portion 54. The elbow portion 63 is rounded at a substantially 90 degree angle from the cavity portions 65, 66 and contiguous with the U-shaped securement portion 81. The interconnecting portion 72 is dimensioned to be received by the receptor portion 54 through swinging the veneer tie 44 into the receptor portions 54, as shown in FIGS. 2 and 10. The interconnecting portion 72 surrounds the receptor portion 54, ensuring high-strength pullout resistance of the veneer tie 44. Once secured within the receptor portion 54, the veneer tie 44 restricts lateral, vertical and horizontal movement.

The veneer tie 44 is a wire formative and has a compressively reduced interconnecting portion 72. As more clearly seen in FIGS. 4 through 7, the interconnecting portion 72 is compressively reduced so that, when viewed as installed, the cross-section taking in a horizontal or an xz-plane that includes the longitudinal axis of the receptor portion 54 shows the greatest dimension substantially oriented along a z-vector. Similarly, when viewed as installed, the major cross-sectional axis 57 of the elbow portions 63, taking in a vertical plane that includes the longitudinal axis of the receptor portion 54, shows the major axis dimension substantially oriented along a z-vector and substantially parallel to the longitudinal axes 17 of the legs 55 of the wall anchor 40.

The illustrations show the manner in which wythe-to-wythe and side-to-side movement is limited by the close fitting relationship between the compressively reduced interconnecting portion 72 and the receptor portion 54. The minor axis 67 of the compressively reduced interconnecting portion 72 is optimally between 30 to 75% of the diameter of the 0.172-to 0.312 inch wire formative and when reduced by one-third has a tension and compression rating of at least 130% of the original wire formative material. The interconnecting portion 72, once compressed, is ribbon-like in appearance; however, maintains substantially the same cross sectional area as the wire formative body.

The insertion portion 74 is optionally configured (as shown in FIG. 3) to accommodate therewithin a reinforcement wire or straight wire member 71 of predetermined diameter. The insertion portion 74 has a compression 79 dimensioned to interlock with the reinforcement wire 71. With this configuration, the bed joint height specification is readily maintained and the reinforcing wire 71 interlocks with the veneer tie 44 within the 0.300-inch tolerance, thereby forming a seismic construct.

The description which follows is of a second embodiment of the high-strength reversible disengagement prevention anchoring system. For ease of comprehension, where similar parts are used reference designators "100" units higher are employed. Thus, the veneer tie 144 of the second embodiment is analogous to the veneer tie 44 of the first embodiment.

Referring now to FIGS. 4 through 11, the second embodiment of the high-strength pintle anchoring system is shown and is referred to generally by the numeral 110. The system 110 employs a sheetmetal wall anchor 140. The dry wall structure 112 is shown having an interior or inner wythe 114 with wallboard 116 as the interior and exterior facings thereof. An exterior or outer wythe 118 of facing brick 120 is attached to dry wall structure 112 and a cavity 122 is formed therebetween. The dry wall structure 112 is constructed to include, besides the wallboard facings 116, vertical channels 124 with insulation layers 126 disposed between adjacent channel members 124. Selected bed joints 128 and 130 of the outer wythe 118 are constructed to be in cooperative functional relationship with the veneer tie described in more detail below.

For purposes of discussion, the exterior surface 125 of the interior wythe 114 contains a horizontal line or x-axis 134 and an intersecting vertical line or y-axis 136. A horizontal line or z-axis 138 also passes through the coordinate origin formed by the intersecting x- and y-axes. The system 110 includes a dry wall anchor 140 constructed for attachment to vertical channel members 124, for embedment in the mortar-filled bed joint 130 and for interconnecting with the veneer tie 144.

Figure 9:
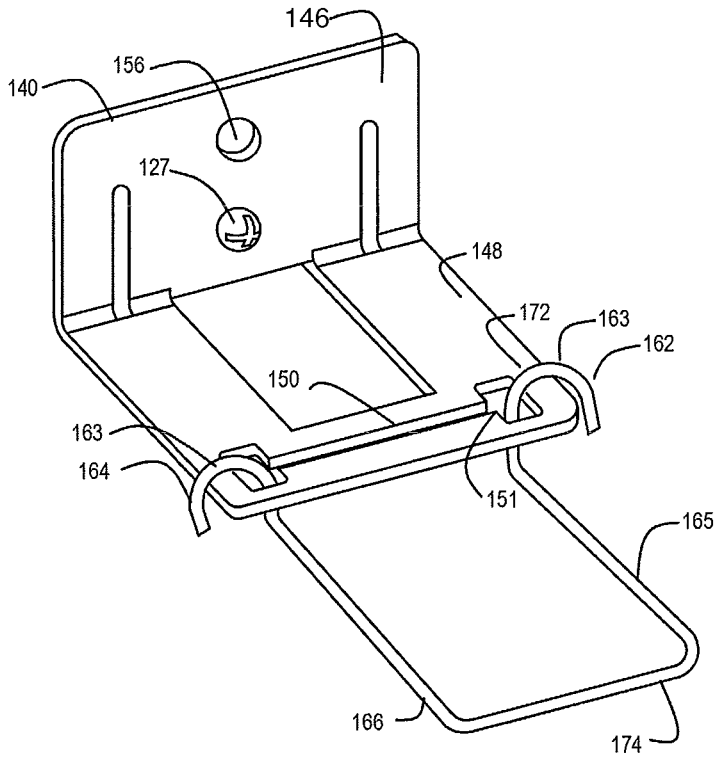
FIG. 9 is a perspective view of a sheet metal anchoring system of this invention having the high-strength veneer tie engaged therewith.

Reference is now directed to the L-shaped, surface-mounted sheetmetal bracket or wall anchor 140 comprising a mounting portion or base plate member 146 and free end, projecting or extending portion 148 into the cavity 122. The projecting or extending portion 148 contains a receptor portion 151 therethrough having a predetermined diameter. The extending portion 148 is contiguous with the base plate member 146 so as to have, upon installation, a horizontally disposed elongated aperture 150 which, as best seen in FIGS. 9 and 10, provides for wire-tie-receiving receptors 151. The aperture 150 is formed in plate member 148. Upon installation, the projecting portion 148 is thus disposed substantially at right angles with respect to the plate member 146. To ease tolerance, receptors 151 may be slightly elongated along the x-axis 134 thereof. The plate member 146 is also provided with mounting holes 156 at the upper and/or lower ends thereof.

As is best seen in FIG. 9, the projecting portion 148 is spaced from the plate member 146 and adapted to receive the interconnecting portion 172 of veneer tie 144 therewithin. In the fabrication of the dry wall as the inner wythe of this construction system 110, the channel members 124 are initially secured in place. In this regard, the channel members 124 may also comprise the standard framing member of a building. Sheets of exterior wallboard 116, which may be of an exterior grade gypsum board, are positioned in abutting relationship with the forward flange of the channel member 124. While the insulating layer 126 is shown as panels dimensioned for use between adjacent column 124, it is to be noted that any similarly suited rigid of flexible insulating material may be used herein with substantially equal efficacy.

After the initial placement of the flexible insulation layer 126 and the wallboard 116, the veneer anchors 140 are secured to the surface of the wallboard 116 in front of channel members 124. Thereafter, sheetmetal screws 127 are inserted into the mounting holes 156 to fasten the anchor 140 to the channel member 124.

The veneer tie 144 is more fully shown in FIGS. 4 through 10. The veneer tie 144, when viewed from a top or bottom elevation, is a modified U-shaped design and is dimensioned to be accommodated by the receptor 151 previously described. The tie 144 is a metal alloy wire formative constructed from mill galvanized, hot-dip galvanized, stainless steel, bright basic steel, or other similar high-strength material and has an insertion portion 174 for disposition in the bed joint 130 of the outer wythe 118.

Two cavity portions 165, 166 are contiguous with the insertion portion 174 and the interconnecting portion 172. The interconnecting portion 172 includes a first ribbon pintle 162 and a second ribbon pintle 164. Each ribbon pintle 162, 164 includes an elbow portion 163 for interconnection with the receptor 151. The elbow portion 163 is rounded at a substantially 90 degree angle from the cavity portions 165, 166 and contiguous with the U-shaped securement portion 181. The interconnecting portion 172 is dimensioned to be received the by the receptor 151 through swinging the veneer tie 144 into the receptor 151, as shown in FIGS. 2 and 10. The interconnecting portion 172 surrounds the receptor 151, ensuring high-strength pullout resistance of the veneer tie 144. Once secured within the receptor 151, the veneer tie 144 prevents displacement, securely holds to the bed joint 130, and restricts lateral, vertical and horizontal movement.

Figure 5:
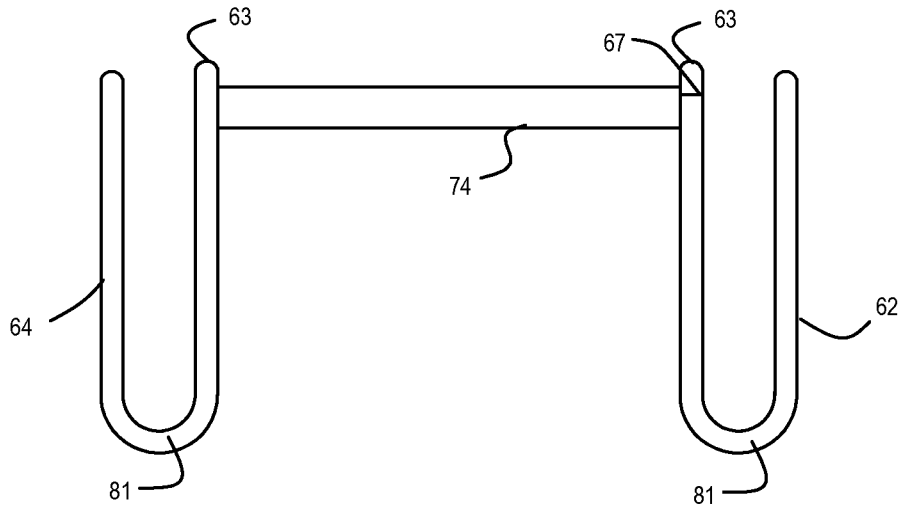
FIG. 5 is a rear view of the veneer tie of this invention.
Figure 4:
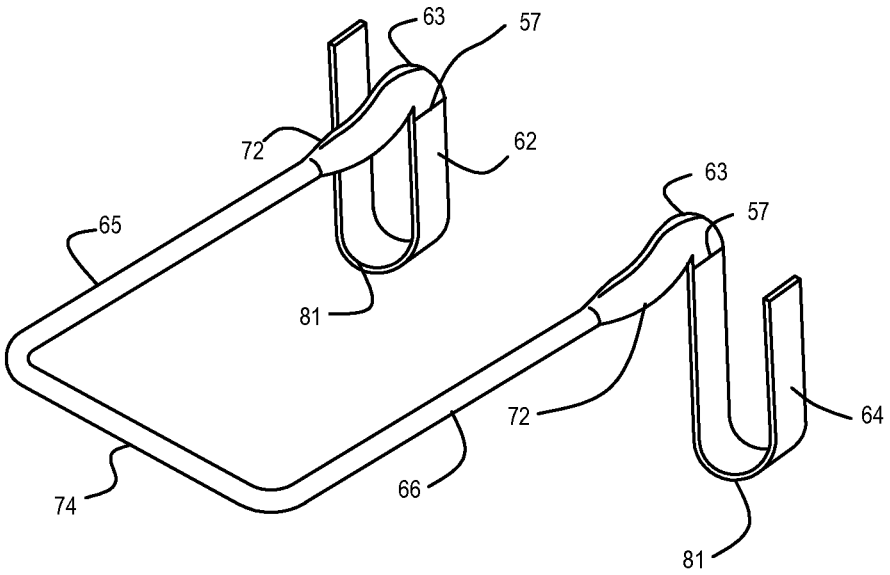
FIG. 4 is a perspective view of the veneer tie of this invention.
Figure 6:
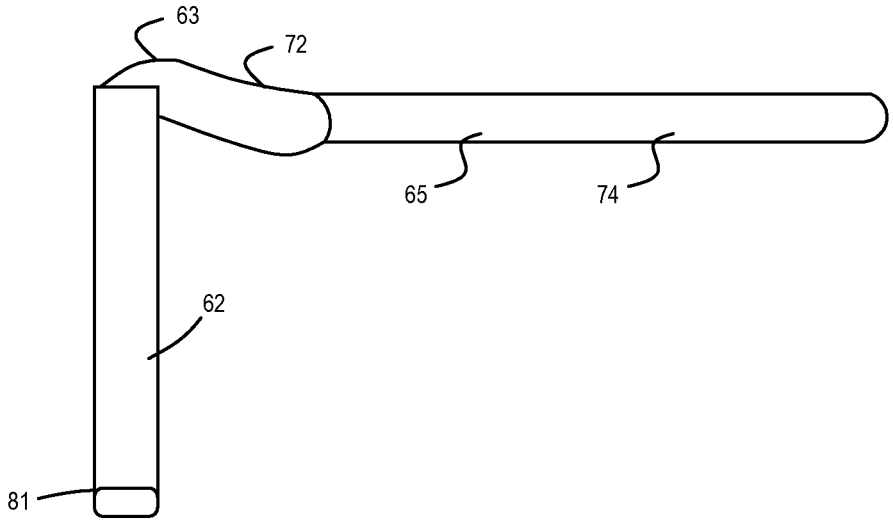
FIG. 6 is a side view of the veneer tie of this invention.
Figure 7:
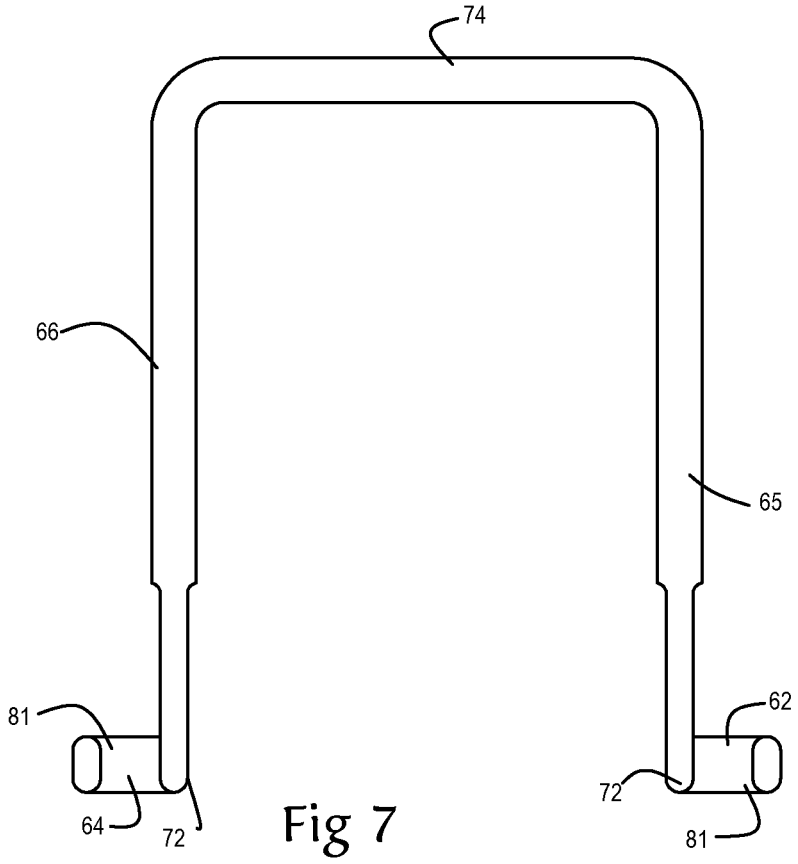
FIG. 7 is a top plan view of the veneer tie of this invention.
Figure 8:
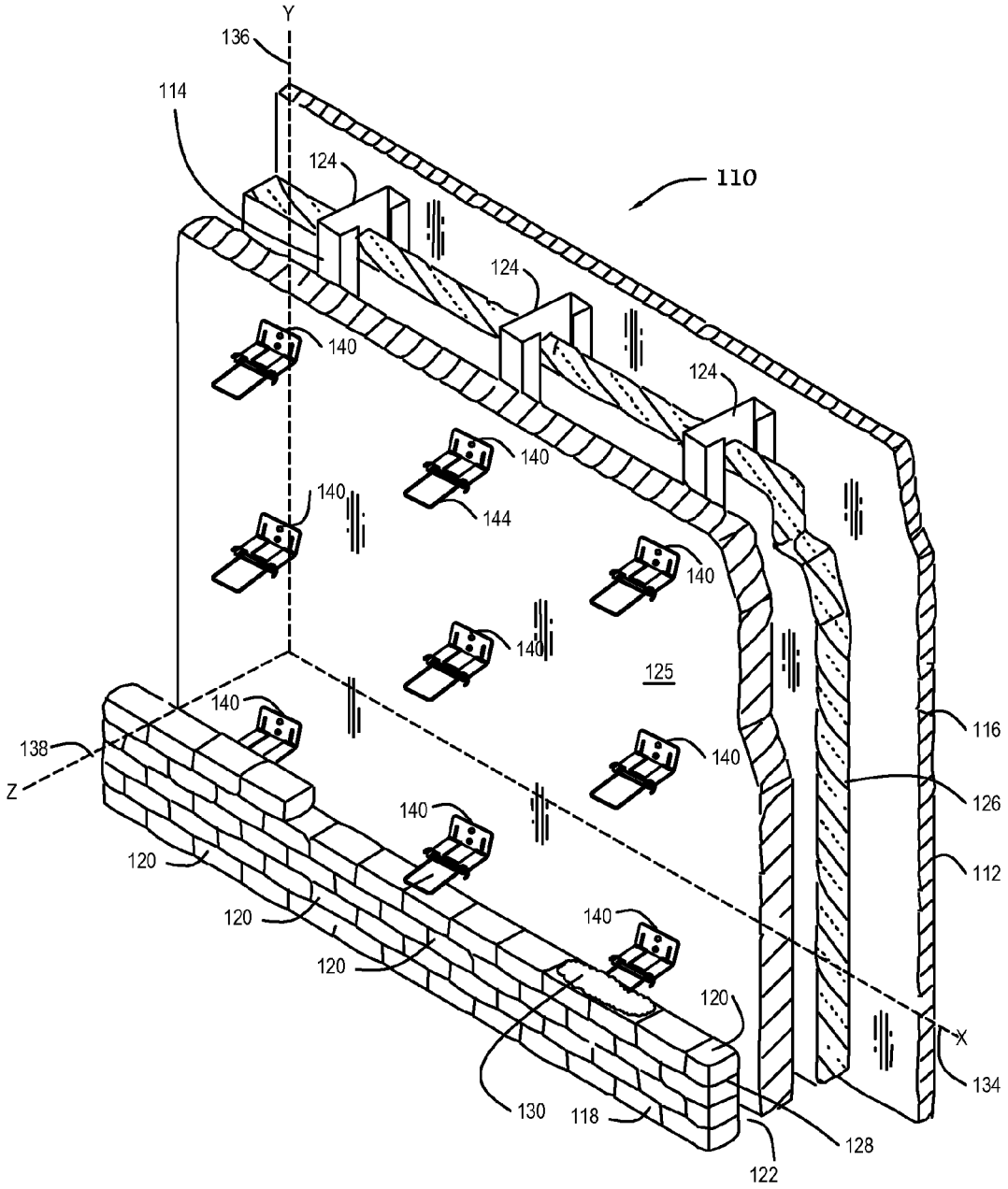
FIG. 8 is a perspective view of an anchoring system of this invention having a disengagement resistant veneer tie with high-strength ribbon pintles interconnected with a sheetmetal anchor for a drywall inner wythe.

The veneer tie 144 is a wire formative and has a compressively reduced interconnecting portion 172. As more clearly seen in FIGS. 4 through 7, the elbow portion 163 has been compressively reduced so that, when viewed as installed, the cross-section taking in a horizontal or an xz-plane that includes the longitudinal axis of the receptor 151 shows the greatest dimension substantially oriented along a z-vector with the major cross-sectional axes 57 (as shown in FIG. 4) of the elbow portion 163 substantially normal to the wall board panels 116. The minor axis 67 (as shown in FIG. 5) of the compressively interconnecting portion 172 is optimally between 30 to 75% of the diameter of the receptor 151 and results in a veneer tie 144 having compressive/tensile strength 130% of the original 0.172- to 0.312-inch wire formative material. The wire formative, once compressed, is ribbon-like in appearance; however, maintains substantially the same cross sectional area as the wire formative body.

The insertion portion 174 is optionally configured (as shown in FIG. 3) to accommodate therewithin a reinforcement wire or straight wire member 71 of predetermined diameter. The insertion portion 174 has a compression 79 dimensioned to interlock with the reinforcement wire 71. With this configuration, the bed joint 130 height specification is readily maintained and the reinforcing wire 71 interlocks with the veneer tie 144 within the 0.300-inch tolerance, thereby forming a seismic construct.

As differentiated from the first embodiment, the dry wall construction system 110 provides for structural integrity by the securement of the anchor construct to the channel member. The anchoring system hereof meets building code requirements for seismic construction and the wall structure reinforcement of both the inner and outer wythes exceeds the testing standards therefor.

Figure 11:
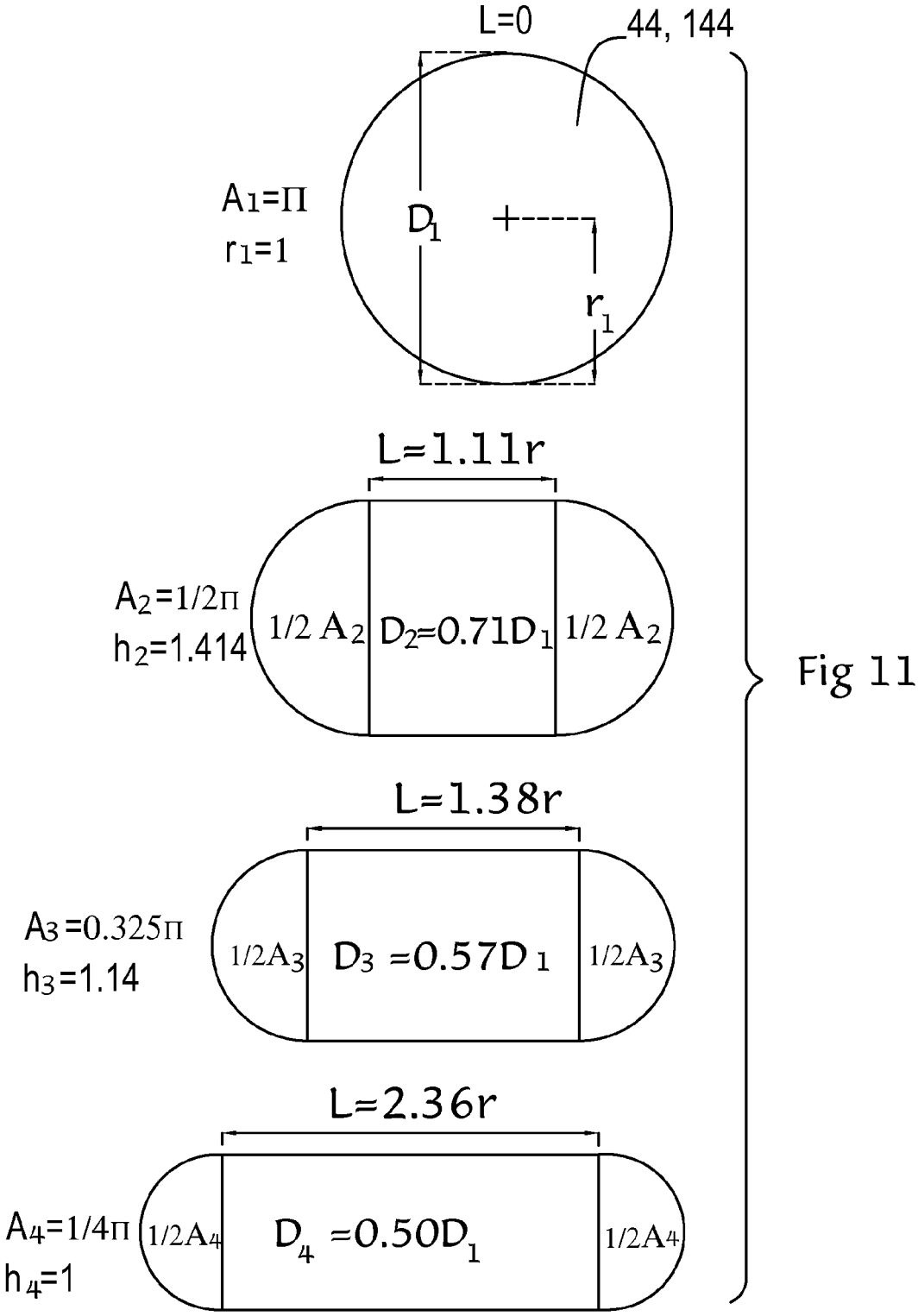

In FIG. 11, the compression of wire formatives is shown schematically. For purposes of discussion, the elongation of the compressed wire is disregarded as the elongation is negligible and the cross-sectional area of the construct remains substantially constant. Here, the veneer tie 144, 44 is formed from a 0.172- to 0.312-inch diameter wire formative and the interconnecting portion 172, 72 is reduced up to 75% of original diameter of the wire formative to a thickness of 0.113- to 0.187-inches. When compared to standard wire formatives, the present invention provides, upon testing, a tension and compression rating that was at least 130% of the rating for the standard tie.

Analytically, the circular cross-section of a wire provides greater flexural strength than a sheetmetal counterpart. In the embodiments described herein the interconnecting portion 172, 72 of the veneer tie 144, 44 is cold-worked or partially flattened so that the specification is maintained and high-strength wire formatives are provided. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween, FIG. 11. The deformed body has substantially the same cross-sectional area as the original wire. In each example in FIG. 11, progressive deformation of a wire is shown. Disregarding elongation and noting the prior comments, the topmost portion shows the original wire having a radius, $r1=1$; and area, $A1=\Pi$; length of deformation, $L=0$; and a diameter, D1. Upon successive deformations, the illustrations shows the area of circular cross-section bring progressively ½, ⅜ and ¼ of the area, A1, or $A2=\frac{1}{2}\Pi$; $A3=\frac{3}{8}\Pi$; and $A4=\frac{1}{4}\Pi$, respectively. With the first deformation, the rectangular portion has a length $L=1.11r$ (in terms of the initial radius of 1); a height, $h2=1.14$; ($D2=0.71D1$, where D=diameter); and therefore has an area of approximately ½Π. Likewise, with the second deformation, the rectangular portion has a length, L=1.38r; a height, h3=1.14; a diameter D3=0.57D1; and therefore has an area of approximately ⅝Π. Yet again, with the third deformation, the rectangular portion has a length, L=2.36r; a height h4=1; a diameter, degree of plastic deformation to remain at a 0.300 inch (approx.) combined height for the truss and wall tie can, as will be seen hereinbelow, be used to optimize the high-strength ribbon pintle anchoring system.

In testing the high-strength veneer tie described hereinabove, the test protocol is drawn from *ASTM Standard E*754-80 (*Reapproved* 2006) entitled, *Standard Test Method for Pullout Resistance of Ties and Anchors Embedded in Masonry Mortar Joints*. This test method is promulgated by and is under the jurisdiction of ASTM Committee E06 on Performance of Buildings and provides procedures for determining the ability of individual masonry ties and anchors to resist extraction from a masonry mortar joint.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A high-strength wire-formative pintle veneer tie for use with an anchoring system in a wall having an inner wythe and an outer wythe a spaced apart and having a cavity therebetween, the outer wythe formed from a plurality of courses with a bed joint of predetermined height between each two adjacent courses, the bed joint being filled with mortar, the veneer tie comprising:

an insertion portion for disposition in the bed joint of the outer wythe;

two cavity portions contiguous with the insertion portion, the cavity portions being interconnected with one another; and, an interconnecting portion comprising a first ribbon pintle and a second ribbon pintle, each ribbon pintle contiguous with one of the cavity portions and set opposite the insertion portion, the first ribbon pintle and the second ribbon pintle each further comprising:

an elbow portion for interconnection with the anchoring system; and, a U-shaped securement portion having a first end contiguous with the elbow portion and opposite the cavity portion, the U-shaped securement portion having a second end and being free from direct connection to the respective cavity portion, the second end spaced apart from the elbow portion, the U-shaped securement portion being compressively reduced such that the U-shaped securement portion has a thickness and a width greater than the thickness, whereby upon insertion of the veneer tie within the anchoring system, the interconnecting portion prevents the veneer tie from disengaging from the anchoring system, while allowing for restricted vertical adjustment.

2. The high-strength pintle veneer tie of claim 1 wherein the interconnecting portion is compressively reduced.

3. The high-strength pintle veneer tie of claim 2 wherein the interconnecting portion is compressively reduced in thickness by up to 75% of the original diameter thereof.

4. The high-strength pintle veneer tie of claim 2, wherein the interconnecting portion is fabricated from 0.172- to 0.312-inch diameter wire and when reduced by one-third has a tension and compression rating at least 130% of the rating for a non-reduced wire formative.

5. The high-strength pintle veneer tie of claim 2, wherein the veneer tie insertion portion further comprises:

a compression dimensioned to interlock with a reinforcement wire; and, a reinforcement wire sized and shaped for being disposed in the compression;

whereby upon insertion of the reinforcement wire in the compression, a seismic construct is formed.

6. The high-strength pintle veneer tie of claim 2, wherein the veneer tie is a metal alloy constructed of material selected from a group consisting of mill galvanized steel, hot-dip galvanized steel, stainless steel, and bright basic steel.

7. A high-strength pintle anchoring system for use in a wall having an inner wythe and an outer wythe spaced apart and having a cavity therebetween, the outer wythe formed from a plurality of courses with a bed joint of predetermined height between each two adjacent courses, the bed joint being filled with mortar, the anchoring system comprising:

a wall anchor adapted to be fixedly attached to the inner wythe and having a free end thereof for extending into the cavity, the free end of the wall anchor comprising:

a receptor portion adapted to be disposed in the cavity; and, a wire-formative veneer tie comprising:

an insertion portion for disposition in the bed joint of the outer wythe;

two cavity portions contiguous with the insertion portion, the cavity portions being interconnected with one another; and, a compressively reduced interconnecting portion comprising a first ribbon pintle and a second ribbon pintle, each ribbon pintle contiguous with one of the cavity portions and set opposite the insertion portion, the first ribbon pintle and the second ribbon pintle each further comprising:

an elbow portion configured for interconnection with the receptor portion of the wall anchor; and, a U-shaped securement portion having a first end contiguous with the elbow portion and opposite the cavity portion, the U-shaped securement portion having a second end and being free from direct connection to the respective cavity portion, the second end spaced apart from the elbow portion, the U-shaped securement portion being compressively reduced such that the U-shaped securement portion has a thickness and a width greater than the thickness, whereby upon interconnection of the veneer tie with the wall anchor, the interconnecting portion prevents the veneer tie from disengaging from the wall anchor, while allowing for restricted vertical adjustment.

8. The high-strength pintle anchoring system of claim 7 wherein the interconnecting portion is compressively reduced in thickness up to 75% of the original diameter thereof.

9. The high-strength pintle anchoring system of claim 7 wherein the interconnecting portion is fabricated from 0.172- to 0.312-inch diameter wire and when reduced by one-third has a tension and compression rating at least 130% of the rating for a non-reduced wire formative.

10. The high-strength pintle anchoring system of claim 9 wherein the receptor portion further comprises a single eyelet adapted to be disposed substantially horizontal in the cavity, the interconnecting portion dimensioned to interconnect with the receptor portion.

11. The high-strength pintle anchoring system of claim 10, the wall anchor further comprising:

two anchor wire formatives adapted to be fixedly attached to a reinforcement ladder or truss, the anchor wire formatives having at least two legs adapted for extending into and terminating within the cavity and being affixed to the eyelet.

12. The high-strength pintle anchoring system of claim 11 wherein each U-shaped securement portion is dimensioned to restrict movement of the interconnecting portion beyond the eyelet and wherein upon insertion of the veneer tie within the eyelet, the U-shaped securement portion restricts vertical movement of the veneer tie.

13. The high-strength pintle anchoring system of claim 12 wherein the elbow portions have a thickness and a width greater than the thickness, the width of each elbow portion being substantially parallel to the longitudinal axes of the legs of the wall anchor.

14. The high-strength pintle anchoring system of claim 13, wherein the veneer tie insertion portion further comprises:

a compression dimensioned to interlock with a reinforcement wire; and, a reinforcement wire adapted to be disposed in the compression;

whereby upon insertion of the reinforcement wire in the compression, a seismic construct is formed.

15. The high-strength pintle anchoring system of claim 9, the wall anchor further comprising:

a surface-mounted sheetmetal bracket adapted to be fixedly attached to the columns of the inner wythe, the sheetmetal bracket being L-shaped and having a mounting portion and an extending portion, the extending portion comprising the receptor portion.

16. The high-strength pintle anchoring system of claim 15 wherein the receptor portion further comprises an elongated aperture and wherein each U-shaped securement portion is dimensioned to restrict movement of the interconnecting portion beyond the elongated aperture.

17. The high-strength pintle anchoring system of claim 16 wherein upon installation a width of each elbow portion is substantially normal to the mounting portion of the sheetmetal bracket.

18. The high-strength pintle anchoring system of claim 17 the veneer tie insertion portion further comprises:

a compression dimensioned to interlock with a reinforcement wire; and, a reinforcement wire adapted to be disposed in the compression;

whereby upon insertion of the reinforcement wire in the compression, a seismic construct is formed.

* * * * *